US010844710B1

(12) United States Patent
Lu et al.

(10) Patent No.: US 10,844,710 B1
(45) Date of Patent: Nov. 24, 2020

(54) METHOD FOR ACQUIRING OPENING TIMING OF NATURAL FRACTURE UNDER IN-SLIT TEMPORARY PLUGGING CONDITION

(71) Applicant: Southwest Petroleum University, Chengdu (CN)

(72) Inventors: Cong Lu, Chengdu (CN); Jianchun Guo, Chengdu (CN); Yang Luo, Chengdu (CN); Bin Qian, Chengdu (CN); Meiping Li, Chengdu (CN); Congbin Yin, Chengdu (CN); Yunchuan Zheng, Chengdu (CN); Yong Ren, Chengdu (CN); Ye Zhong, Chengdu (CN); Chi Chen, Chengdu (CN); Yongjun Xiao, Chengdu (CN); Xianjun He, Chengdu (CN)

(73) Assignee: SOUTHWEST PETROLEUM UNIVERSITY, Chengdu (CN)

( * ) Notice: Subject to any disclaimer, the term of this patent is extended or adjusted under 35 U.S.C. 154(b) by 0 days.

(21) Appl. No.: 16/550,336

(22) Filed: Aug. 26, 2019

(30) Foreign Application Priority Data

May 10, 2019 (CN) ..... 2019 1 0387470

(51) Int. Cl.
*E21B 49/00* (2006.01)
*E21B 33/138* (2006.01)
*E21B 43/26* (2006.01)

(52) U.S. Cl.
CPC ..... *E21B 49/00* (2013.01); *E21B 33/138* (2013.01); *E21B 43/26* (2013.01)

(58) Field of Classification Search
CPC ..... E21B 43/26; E21B 33/138; E21B 49/00; Y02P 90/70
See application file for complete search history.

(56) References Cited

U.S. PATENT DOCUMENTS

| | | | | |
|---|---|---|---|---|
| 4,850,431 | A * | 7/1989 | Austin | E21B 43/26 166/308.1 |
| 7,571,777 | B2 * | 8/2009 | Wylie | C09K 8/12 175/50 |
| 8,839,875 | B2 * | 9/2014 | Enis | E21B 43/164 166/402 |
| 2019/0128068 | A1 * | 5/2019 | Danko | E21B 47/06 |

* cited by examiner

*Primary Examiner* — Elias Desta

(57) ABSTRACT

A method for acquiring an opening timing of natural fracture under an in-slit temporary plugging condition and a device thereof are provided. The method includes steps of: acquiring physical parameters of stratum according to site geological data, and measuring a slit length L of a hydraulic fracture; dividing the hydraulic fracture into N unit bodies of equal length and numbering them sequentially; and dividing a total calculation time t into meter fractions of time with equal interval; calculating a width of each unit body in the hydraulic fracture at the initial time; calculating a fluid pressure in the hydraulic fracture at the k-th fraction of time; calculating a closed pressure at an entrance of the natural fracture on an upper side and a lower side of the hydraulic fracture at the k-th fraction of time; and determining whether the natural fracture is opened by a determining criteria based on the above calculation results.

4 Claims, 2 Drawing Sheets

METHOD FOR ACQUIRING OPENING TIMING OF NATURAL FRACTURE UNDER IN-SLIT TEMPORARY PLUGGING CONDITION

FIELD OF THE INVENTION

The present invention relates to a method for acquiring an opening timing of natural fracture under an in-slit temporary plugging condition and a device thereof, which belongs to the field of oil and gas exploration and development.

BACKGROUND OF THE INVENTION

Hydraulic fracturing technology is an important means for increased production of low permeability oil and gas reservoirs. Hydraulic fracturing means that a set of ground high-pressure pumps is used to pump the fracturing fluid into the stratum with a displacement exceeding the absorption capacity of the stratum to produce hydraulic fracture, and then a fracturing fluid with proppant (sand particles) is continued to be injected to allow the fracture to continue to extend and be further filled with the proppant. When the fracturing fluid is discharged to return, the proppant acts as a support in the fracture for preventing the fracture from closing due to the pressure of the stratum, so that a sand-filling fracture having a certain length and flowability is formed in the stratum.

In-slit temporary plugging turnaround fracturing is a form of hydraulic fracturing, specifically, refers to that during the fracturing process, the temporary plugging agent is pumped to temporarily block the hydraulic fracture tip, artificially restricting the hydraulic fracture tip to extend forward, forcing the fluid pressure inside the hydraulic fracture to rise sharply, thereby opening natural fracture around the hydraulic fracture, so as to increase the range of fracturing. Therefore, accurately acquiring an opening timing for natural fracture under the in-slit temporary plugging condition is of great significance for the prediction of natural fracture extension process and the design in temporary plugging turnaround fracturing process.

Temporary plugging failure refers to the phenomenon that the fracturing fluid inside the hydraulic fracture breaks through temporary plugging regions at the tip during the fracturing process, causing the temporary plugging section to lose its plugging effect, and then the hydraulic fracture continues to extend forward along the original path. Generally, the temporary plugging failure occurs when the difference between the pressures on both sides of the temporary plugging section reaches a critical value, which is also called temporary plugging strength, determined by the property of the temporary plugging agent itself.

Natural fracture is named as opposed to artificial fracture that are otherwise manmade, and natural fracture refers to a type of fracture in the stratum that naturally occurs due to crustal movement or other natural factors. During the hydraulic fracturing, when the hydraulic fracture extends forward, it usually meets the natural fracture, at which time there are two possible situations: the hydraulic fracture passes directly through the natural fracture to extend forward along the original path, or the hydraulic fracture extends forward along the path where the natural fracture is located. The temporary plugging turnaround fracturing in the fracture is mainly applicable to the first situation, that is, when the hydraulic fracture passes through the natural fracture, the natural fracture remains closed, and then increasing the fluid pressure inside the hydraulic fracture by pumping the temporary plugging agent forces the natural fracture to open. In addition, according to the relative position upon the hydraulic fracture intersecting with the natural fracture, the intersection process may be divided into two types: orthogonal (vertically intersecting) and non-orthogonal.

Induced stress refers to a force induced by the other positions of the material against the external force when a position of the material is subjected to an external force. For hydraulic fracturing, the length and width of hydraulic fracture increase continuously during the fracturing process, resulting in a continuously increased extrusion on the surrounding rocks, so that the induced stress generated inside the rock increases continuously, which may also indirectly affect the opening process of the natural fracture.

In response to achieving a viable method for acquiring opening timing of natural fracture during hydraulic fracturing, scholars at home and abroad have done a lot of studies. However, most of conventional studies only aim at determining the opening time when the hydraulic fracture tip meets the natural fracture, but without specifically analyzing the opening timing of the natural fracture in the case of also applying in-slit temporary plugging onto the tip after the hydraulic fracture passes through the natural fracture. At the same time, for the case of non-orthogonality between the hydraulic fracture and the natural fracture, scholars only directly assume that natural fracture on one side of hydraulic fracture will open, without comparing the forces of natural fracture on both sides. Therefore, these conventional methods may not reflect or predict well the actual opening process of natural fracture under the in-slit temporary plugging condition.

It should be noted that the above description of the technical background is merely for the purpose of facilitating a clear and complete description of technical solutions of the present invention, and is convenient for understanding by those skilled in the art. The above technical solutions should not be considered to be well-known to those skilled in the art, simply because these aspects are set forth in background section of the present invention.

SUMMARY OF THE INVENTION

In order to solve the above problems in the prior art, it is an object of the present invention to provide a method for acquiring an opening timing of natural fracture under an in-slit temporary plugging condition. The method is reliable in principle, high in calculation accuracy, and may accurately calculate the opening timing of natural fracture during the temporary plugging turnaround fracturing, further providing effective guidance for design in fracturing solution.

The method includes the following steps:

step S10: acquiring physical parameters of stratum according to site geological data, and measuring a slit length L of a hydraulic fracture;

step S20: dividing the hydraulic fracture into N unit bodies of equal length and numbering them sequentially, wherein the length of each unit body being L/N; and using an in-slit temporary plugging time as an initial time t0, and dividing a total calculation time t into meter fractions of time with equal interval, wherein an interval time of the adjacent time nodes being t/m;

step S30: calculating a width of each unit body in the hydraulic fracture at the initial time;

step S40: calculating a fluid pressure in the hydraulic fracture at the k-th fraction of time;

step S50: calculating a closed pressure at an entrance of the natural fracture on an upper side and a lower side of the hydraulic fracture at the k-th fraction of time; and Step S60: determining whether the natural fracture is opened by a determining criteria based on the calculation results of the above steps S40 and S50;

if yes, the time $$t_0 + kt/m$$

corresponding to the time node k is the opening time of the natural fracture;

if not, then letting k=k+1, repeating steps S40-S50 until the natural fracture is opened or the temporary plugging section fails;

the determining criteria include:

if $P^k > \sigma_u^k$, the upper side of the natural fracture is opened;

if $P^k < \sigma_l^k$, the lower side of the natural fracture is opened;

if $P^k > P_c + P_r$, the temporary plugging section fails;

wherein $P^k$ is a fluid pressure in the hydraulic fracture at the k-th fraction of time; $\sigma_u^k$ is the closed pressure at the entrance of the natural fracture on the upper side of the hydraulic fracture at the k-th fraction of time, MPa; $\sigma_l^k$ is the closed pressure at the entrance of the natural fracture on the lower side of the hydraulic fracture at the k-th fraction of time, MPa; $P_c$ is a plugging strength of the temporary plugging section, MPa; $P_r$ is a fluid pressure of the stratum, MPa.

In one embodiment, a calculation formula in the step S30 is:

$$P^0 - \sigma_h = \sum_{i=1}^{N} \frac{GN}{\pi L(1-\upsilon)} \left\{ 1 - \frac{d_{ij}^{\beta}}{[d_{ij}^2 + (H/\alpha)^2]^{\beta/2}} \right\} \left( \frac{1}{2j-2i+1} - \frac{1}{2j-2i+1} \right) W_i^0 (j = 1, 2, \ldots N);$$

wherein $p^0$ is a fluid pressure in the hydraulic fracture at the initial time t0, MPa; $\sigma_h$ is a minimum horizontal principal stress of the stratum, MPa; G is a shear modulus of a stratum rock, MPa; $\upsilon$ is the Poisson's ratio of the stratum rock, no factor; L is a total length of hydraulic fracture, meter; N is the divided number of unit bodies of the hydraulic fracture; $d_{ij}$ is a distance between the midpoints of the fracture unit body i and the fracture unit body j, meter; H is a height of the hydraulic fracture, meter; $\alpha$, $\beta$ are empirical coefficients, taken $\alpha$=1, $\beta$=2.3; i, j is the number of the unit body of the hydraulic fracture; $W_i^0$ is a width of the i-th unit body of the hydraulic fracture at the initial time, meter.

In one embodiment, the step S40 includes the following sub-steps:

sub-step S401: calculating an estimated fluid pressure in the hydraulic fracture at the k-th fraction of time according to the following formula:

$$\begin{cases} \hat{p}^k = p^0 (k = 1) \\ \hat{p}^k = 1.25 p^{k-1} (k > 1) \end{cases};$$

wherein $p^0$ is the fluid pressure in the hydraulic fracture at the initial time, MPa; $p^{k-1}$ is an actual fluid pressure in the hydraulic fracture at the (k−1)-th fraction of time; $\hat{p}^k$ is an estimated fluid pressure in the hydraulic fracture at the k-th fraction of time, MPa;

sub-step S402: calculating an estimated width of each unit body of the hydraulic fracture at the k-th fraction of time according to the estimated fluid pressure calculated above and the following formula:

$$\hat{P}^k - \sigma_h = \sum_{i=1}^{N} \frac{GN}{\pi L(1-\upsilon)} \left\{ 1 - \frac{d_{ij}^{\beta}}{[d_{ij}^2 + (H/\alpha)^2]^{\beta/2}} \right\} \left( \frac{1}{2j-2i+1} - \frac{1}{2j-2i+1} \right) \hat{W}_i^k (j = 1, 2, \ldots N);$$

wherein $\hat{p}^k$ is an estimated fluid pressure in the hydraulic fracture at the k-th fraction of time, MPa; $\sigma_h$ is a minimum horizontal principal stress of the stratum, MPa; G is a shear modulus of a stratum rock, MPa; $\upsilon$ is the Poisson's ratio of the stratum rock, no factor; L is a total length of hydraulic fracture, meter; N is the divided number of unit bodies of the hydraulic fracture; $d_{ij}$ is a distance between the midpoints of the fracture unit body i and the fracture unit body j, meter; H is a height of the hydraulic fracture, meter; $\alpha$, $\beta$ are empirical coefficients, taken $\alpha$=1, $\beta$=2.3; i, j is the number of the unit body of hydraulic fracture; $\hat{W}_i^k$ is an estimated width of each unit body of the hydraulic fracture at the k-th fraction of time, meter;

sub-step S403: calculating an error $\alpha$ of the estimated width by the following formula:

$$\alpha = \frac{HL\left( \sum_{i=1}^{N} \hat{W}_i^k - \sum_{i=1}^{N} W_i^{k-1} \right)}{NQ\Delta t};$$

wherein $\hat{W}_i^k$ is an estimated width of each unit of the hydraulic fracture at the k-th fraction of time, meter; $\hat{W}_i^{k-1}$ is an estimated width of each unit of the hydraulic fracture at the (k−1)-th fraction of time, meter; H is a height of the hydraulic fracture, meter; L is a total length of the hydraulic fracture, meter; N is the divided number of unit bodies of the hydraulic fracture; Q is a pumping displacement of fracturing fluid after in-slit temporary plugging, m3/s; $\Delta t$ is an interval time of adjacent time nodes, s; i is the number of unit bodies of the hydraulic fracture; $\alpha$ is the error; and sub-step S404: setting solution accuracy $\varepsilon$, and comparing the error $\alpha$ obtained above with the solution accuracy $\varepsilon$;

if $\beta \le \varepsilon$, $\hat{P}^k$ and $\hat{W}_i^k$ calculated in step S402 and step S403 are respectively the fluid pressure in the hydraulic fracture at the k-th fraction of time and the width of each unit body; if $\alpha > \varepsilon$, then re-estimating the fluid pressure using the following formula and repeating steps S402-S404 until $\alpha \le \varepsilon$ is satisfied;

$$\begin{cases} \hat{P}^k = \dfrac{\hat{P}^k}{1 + 10\alpha} (\alpha > 0) \\ \hat{P}^k = (1 - 10\alpha)\hat{P}^k (\alpha < 0) \end{cases};$$

wherein $\varepsilon$ is a solution accuracy; $\hat{p}^k$ is an estimated fluid pressure in the hydraulic fracture at the k-th fraction of time, MPa; $\alpha$ is an error.

In one embodiment, a calculation formula in the step S50 is:

$$\begin{cases} \sigma_u^k = \left(\frac{\sigma_H+\sigma_h}{2} - \frac{\sigma_H-\sigma_h}{2}\cos 2\omega\right) + \\ \sum_{i=1}^{N}\left\{1 - \frac{d_{ui}^{\beta}}{[d_{ui}^2 + (H/\alpha)^2]^{\beta/2}}\right\} C^{ui} W_i^k \\ \sigma_l^k = \left(\frac{\sigma_H+\sigma_h}{2} - \frac{\sigma_H-\sigma_h}{2}\cos 2\omega\right) + \\ \sum_{i=1}^{N}\left\{1 - \frac{d_{li}^{\beta}}{[d_{li}^2 + (H/\alpha)^2]^{\beta/2}}\right\} C^{li} W_i^k \end{cases};$$

wherein $\sigma_u^k$ is a closed pressure at an entrance of the natural fracture on an upper side of the hydraulic fracture at the k-th fraction of time, MPa; $\sigma_l^k$ is a closed pressure at an entrance of the natural fracture on a lower side of the hydraulic fracture at the k-th fraction of time, MPa; $\sigma_H$ is a maximum horizontal principal stress of the stratum, MPa; $\sigma_h$ is a minimum horizontal principal stress of the stratum, MPa; ω is an angle between the hydraulic fracture and the natural fracture; $d_{ui}$ is a distance between the midpoint of the upper natural fracture entrance unit and the midpoint of the hydraulic fracture unit i, meter; $d_{li}$ is a distance between the midpoint of the lower natural fracture entrance unit and the midpoint of the hydraulic fracture unit i, meter; H is a height of the hydraulic fracture, meter; α, β is an empirical coefficient, taken α=1, β=2.3; $W_i^k$ is a width of the unit body i of the hydraulic fracture at the k-th fraction of time, meter; $C^{ui}$, $C^{li}$ are the shape coefficients of the upper and lower natural fracture entrance unit bodies with respect to the unit body i of the hydraulic fracture, respectively.

In one embodiment, the shape coefficients of the upper and lower natural fracture entrance unit bodies with respect to the unit body i of the hydraulic fracture are obtained by the following sub-steps:

sub-step S501: establishing a global coordinate system with a center point of the first hydraulic fracture unit body as an origin, a length direction of the hydraulic fracture as an X-axis, a direction passing through the origin and perpendicular to the wall surface of the hydraulic fracture as a Y-axis;

sub-step S502: expressing the coordinates of the midpoint of the upper and lower natural fracture entrance unit bodies in the global coordinate system as:

$$\begin{cases} x_u = x_r + \frac{L}{N}\cos\omega \\ y_u = \frac{L}{N}\sin\omega \\ x_l = x_r - \frac{L}{N}\cos\omega \\ y_l = -\frac{L}{N}\sin\omega \end{cases};$$

wherein $\bar{x}_u$, $\bar{y}_u$ is a coordinate of the midpoint of the upper natural fracture entrance unit bodies in the global coordinate system; $\bar{x}_l$, $\bar{y}_l$ is a coordinate of the midpoint of the lower natural fracture entrance unit bodies in the global coordinate system; $\bar{x}_r$ is an abscissa of the point where the hydraulic fracture intersects the natural fracture in the global coordinate system; L is a total length of hydraulic fracture, meter; N is the divided number of unit bodies of the hydraulic fracture; ω is an angle between the hydraulic fracture and the natural fracture, degree;

sub-step S503: expressing the coordinates of the midpoint of the upper and lower natural fracture entrance unit bodies in a local coordinate system based on the midpoint of the hydraulic fracture unit body i as:

$$\begin{cases} x_{ui} = \left(x_r + \frac{L}{N}\cos\omega - x_i\right)\cos\omega + \left(\frac{L}{N}\sin\omega - \bar{y}_i\right)\sin\omega \\ y_{ui} = -\left(x_r + \frac{L}{N}\cos\omega - x_i\right)\sin\omega + \left(\frac{L}{N}\sin\omega - \bar{y}_i\right)\cos\omega \\ x_{li} = \left(x_r - \frac{L}{N}\cos\omega - x_i\right)\cos\omega - \left(\frac{L}{N}\sin\omega + \bar{y}_i\right)\sin\omega \\ y_{li} = -\left(x_r - \frac{L}{N}\cos\omega - x_i\right)\sin\omega - \left(\frac{L}{N}\sin\omega + \bar{y}_i\right)\cos\omega \end{cases};$$

wherein $x_{ui}$, $y_{ui}$ is a coordinate of the midpoint of the upper natural fracture entrance unit bodies in the local coordinate system; $x_{li}$, $y_{li}$ is a coordinate of the midpoint of the lower natural fracture entrance unit bodies in the local coordinate system; $\bar{x}_i$, $\bar{y}_i$ is a coordinate of the unit body i of the hydraulic fracture in the global coordinate system; $\bar{x}_r$ an abscissa of the point where the hydraulic fracture intersects the natural fracture in the global coordinate system; L is a total length of hydraulic fracture, meter; N is the divided number of unit bodies of hydraulic fracture; ω is an angle between the hydraulic fracture and the natural fracture, degree; and sub-step S504: placing the formula in sub-step (S503) into the following formula for solution to obtain the shape coefficients of the upper and lower natural fracture entrance unit bodies with respect to the unit body i of the hydraulic fracture;

$$C^{ij}=2G[-f_1+y_{ij}(f_2 \sin 2\gamma^{ij}-f_3 \cos 2\gamma^{ij})];$$

$$\begin{cases} f_1 = \frac{1}{4\pi(1-\nu)}\left[\frac{x_{ij}-a}{(x_{ij}-a)^2+y_{ij}^2} - \frac{x_{ij}+a}{(x_{ij}+a)^2+y_{ij}^2}\right] \\ f_2 = \frac{l}{4\pi(1-\nu)}\left[\frac{(x_{ij}-a)^2-y_{ij}^2}{[(x_{ij}-a)^2+y_{ij}^2]^2} - \frac{(x_{ij}+a)^2-y_{ij}^2}{[(x_{ij}+a)^2+y_{ij}^2]^2}\right] \\ f_3 = \frac{2y}{4\pi(1-\nu)}\left[\frac{x_{ij}-a}{[(x_{ij}-a)^2+y_{ij}^2]^2} - \frac{x_{ij}+a}{[(x_{ij}+a)^2+y_{ij}^2]^2}\right] \end{cases};$$

wherein $\delta_j^k$ is a normal stress of the fracture unit body j at the k-th fraction of time, MPa; G is a shear modulus of the stratum rock, MPa; υ is the Poisson's ratio of the stratum rock, no factor; $d_{ij}$ is the distance between the midpoints of the fracture unit i and the fracture unit j, meter; H is a height of the hydraulic fracture, meter; α, β are empirical coefficients, taken α=1, β=2.3; i, j is the number of the unit body of hydraulic fracture; $W_i^0$ is a width of the i-th unit body of hydraulic fracture at the initial time, meter; $C^{ij}$ is a shape coefficient of the fracture unit j with respect to the unit body i of the hydraulic fracture; $\gamma^{ij}$ is a deflection angle of the fracture unit body i with respect to the fracture unit body j; a is a half-length of the fracture unit body, that is, L/2N, meter; $x_{ij}$, $y_{ij}$ is a coordinate value of the midpoint of the fracture unit body j in the local coordinate system based on the midpoint of the fracture unit body i.

According to another exemplary embodiment, a device for acquiring an opening timing of natural fracture under an in-slit temporary plugging condition is provided. The device includes an acquisition module, a division module, a width calculation module, a fluid pressure calculation module, a closed pressure calculation module, and a determination module. The acquisition module is configured to acquire physical parameters of stratum according to site geological data, and measure a slit length L of a hydraulic fracture. The division module is configured to divide the hydraulic fracture into N unit bodies of equal length and number them sequentially, wherein the length of each unit body being L/N; and use an in-slit temporary plugging time as an initial time t0, and divide a total calculation time t into meter fractions of time with equal interval, wherein an interval time of the adjacent fractions of time being t/m. The width calculation module is configured to calculate a width of each unit body in the hydraulic fracture at the initial time. The fluid pressure calculation module is configured to calculate a fluid pressure in the hydraulic fracture at the k-th fraction of time. The closed pressure calculation module is configured to calculate a closed pressure at an entrance of the natural fracture on an upper side and a lower side of the hydraulic fracture at the k-th fraction of time. The determination module is configured to determine whether the natural fracture is opened by a determining criteria based on calculation results of the fluid pressure calculation module and the closed pressure calculation module. If yes, the time $$t_0 + \frac{kt}{m}$$

corresponding to the fraction of time k is the opening time of the natural fracture; if not, then letting k=k+1, repeating steps S40-S50 until the natural fracture is opened or the temporary plugging section fails.

The determining criteria include:

if $P^k > \sigma_u^k$, the upper side of the natural fracture is opened;

if $P^k < \sigma_l^k$, the lower side of the natural fracture is opened;

if $P^k > P_c + P_r$, the temporary plugging section fails;

wherein $P^k$ is a fluid pressure in the hydraulic fracture at the k-th fraction of time; $\sigma_u^k$ is the closed pressure at the entrance of the natural fracture on the upper side of the hydraulic fracture at the k-th fraction of time, MPa; $\sigma_l^k$ is the closed pressure at the entrance of the natural fracture on the lower side of the hydraulic fracture at the k-th fraction of time, MPa; $P_c$ is a plugging strength of the temporary plugging section, MPa; $P_r$ is a fluid pressure of the stratum, MPa.

In one embodiment, the width calculation module is further configured to calculate the width of each unit body in the hydraulic fracture based on the following calculation formula:

$$P^0 - \sigma_h = \sum_{i=1}^{N} \frac{GN}{\pi L(1-\nu)} \left\{ 1 - \frac{d_{ij}^{\beta}}{[d_{ij}^2 + (H/\alpha)^2]^{\beta/2}} \right\} \left( \frac{1}{2j-2i+1} - \frac{1}{2j-2i+1} \right) W_i^0 \quad (j = 1, 2, \ldots, N);$$

wherein $p^0$ is a fluid pressure in the hydraulic fracture at the initial time t0, MPa; $\sigma_h$ is a minimum horizontal principal stress of the stratum, MPa; G is a shear modulus of a stratum rock, MPa; $\upsilon$ is the Poisson's ratio of the stratum rock, no factor; L is a total length of hydraulic fracture, meter; N is the divided number of unit bodies of the hydraulic fracture; $d_{ij}$ is a distance between the midpoints of the fracture unit body i and the fracture unit body j, meter; H is a height of the hydraulic fracture, meter; $\alpha$, $\beta$ are empirical coefficients, taken $\alpha$=1, $\beta$=2.3; i, j is the number of the unit body of the hydraulic fracture; $W_i^0$ is a width of the i-th unit body of the hydraulic fracture at the initial time, meter.

In one embodiment, the fluid pressure calculation module is further configured to:

calculate an estimated fluid pressure in the hydraulic fracture at the k-th fraction of time according to the following formula:

$$\begin{cases} \hat{p}^k = p^0 & (k = 1) \\ \hat{p}^k = 1.25 p^{k-1} & (k > 1) \end{cases};$$

wherein $p^0$ is the fluid pressure in the hydraulic fracture at the initial time, MPa; $p^{k-1}$ is an actual fluid pressure in the hydraulic fracture at the (k−1)-th fraction of time; $\hat{p}^k$ is an estimated fluid pressure in the hydraulic fracture at the k-th fraction of time, MPa;

calculate an estimated width of each unit body of the hydraulic fracture at the k-th fraction of time according to the estimated fluid pressure calculated above and the following formula:

$$\hat{P}^k - \sigma_h = \sum_{i=1}^{N} \frac{GN}{\pi L(1-\nu)} \left\{ 1 - \frac{d_{ij}^{\beta}}{[d_{ij}^2 + (H/\alpha)^2]^{\beta/2}} \right\} \left( \frac{1}{2j-2i+1} - \frac{1}{2j-2i+1} \right) \hat{W}_i^k \quad (j = 1, 2, \ldots, N);$$

wherein $\hat{p}^k$ is an estimated fluid pressure in the hydraulic fracture at the k-th fraction of time, MPa; $\sigma_h$ is a minimum horizontal principal stress of the stratum, MPa; G is a shear modulus of a stratum rock, MPa; $\upsilon$ is the Poisson's ratio of the stratum rock, no factor; L is a total length of hydraulic fracture, meter; N is the divided number of unit bodies of the hydraulic fracture; $d_{ij}$ is a distance between the midpoints of the fracture unit body i and the fracture unit body j, meter; H is a height of the hydraulic fracture, meter; $\alpha$, $\beta$ are empirical coefficients, taken $\alpha$=1, $\beta$=2.3; i, j is the number of the unit body of hydraulic fracture; $\hat{W}_i^k$ is an estimated width of each unit body of the hydraulic fracture at the k-th fraction of time, meter;

calculate an error $\alpha$ of the estimated width by the following formula:

$$\alpha = \frac{HL\left( \sum_{i=1}^{N} \hat{W}_i^k - \sum_{i=1}^{N} W_i^{k-1} \right)}{NQ\Delta t};$$

wherein $\hat{W}_i^k$ is an estimated width of each unit of the hydraulic fracture at the k-th fraction of time, m; $W_i^{k-1}$ is an estimated width of each unit of the hydraulic fracture at the (k−1)-th fraction of time, meter; H is a height of the hydraulic fracture, meter; L is a total length of the hydraulic fracture, meter; N is the divided number of unit bodies of the hydraulic fracture; Q is a pumping displacement of fracturing fluid after in-slit temporary plugging, m3/s; $\Delta t$ is an interval time of adjacent fractions of time, s; i is the number of unit bodies of the hydraulic fracture; $\alpha$ is the error; and set solution accuracy $\varepsilon$, and comparing the error $\alpha$ obtained above with the solution accuracy $\varepsilon$;

if $\alpha \le \varepsilon$, $\hat{P}^k$ and $\hat{W}_i^k$ calculated above are respectively the fluid pressure in the hydraulic fracture at the k-th fraction of time and the width of each unit body; if $\alpha > \varepsilon$, then re-estimate the fluid pressure using the following formula and repeating the above steps until $\alpha \le \varepsilon$ is satisfied;

$$\begin{cases} \hat{P}^k = \dfrac{\hat{P}^k}{1+10\alpha} & (\alpha > 0) \\ \hat{P}^k = (1-10\alpha)\hat{P}^k & (\alpha < 0) \end{cases};$$

wherein $\varepsilon$ is a solution accuracy; $\vec{p}^k$ is an estimated fluid pressure in the hydraulic fracture at the k-th fraction of time, MPa; $\alpha$ is an error.

In one embodiment, the closed pressure calculation module is configured to calculate the closed pressure at the entrance of the natural fracture based on the following formula:

$$\begin{cases} \sigma_u^k = \left(\dfrac{\sigma_H+\sigma_h}{2} - \dfrac{\sigma_H-\sigma_h}{2}\cos 2\omega\right) + \\ \displaystyle\sum_{i=1}^{N}\left\{1 - \frac{d_{ui}^{\beta}}{[d_{ui}^2 + (H/\alpha)^2]^{\beta/2}}\right\} C^{ui} W_i^k \\ \sigma_l^k = \left(\dfrac{\sigma_H+\sigma_h}{2} - \dfrac{\sigma_H-\sigma_h}{2}\cos 2\omega\right) + \\ \displaystyle\sum_{i=1}^{N}\left\{1 - \frac{d_{li}^{\beta}}{[d_{li}^2 + (H/\alpha)^2]^{\beta/2}}\right\} C^{li} W_i^k \end{cases};$$

wherein $\sigma_u^k$ is a closed pressure at an entrance of the natural fracture on an upper side of the hydraulic fracture at the k-th fraction of time, MPa; $\sigma_l^k$ is a closed pressure at an entrance of the natural fracture on a lower side of the hydraulic fracture at the k-th fraction of time, MPa; $\sigma_H$ is a maximum horizontal principal stress of the stratum, MPa; $\sigma_h$ is a minimum horizontal principal stress of the stratum, MPa; $\omega$ is an angle between the hydraulic fracture and the natural fracture; $d_{ui}$ is a distance between the midpoint of the upper natural fracture entrance unit and the midpoint of the hydraulic fracture unit i, meter; $d_{li}$ is a distance between the midpoint of the lower natural fracture entrance unit and the midpoint of the hydraulic fracture unit i, meter; H is a height of the hydraulic fracture, meter; $\alpha$, $\beta$ is an empirical coefficient, taken $\alpha=1$, $\beta=2.3$; $W_i^k$ is a width of the unit body i of the hydraulic fracture at the k-th fraction of time, meter; $C^{ui}$, $C^{li}$ are the shape coefficients of the upper and lower natural fracture entrance unit bodies with respect to the unit body i of the hydraulic fracture, respectively.

In one embodiment, the closed pressure calculation module is further configured to:

establish a global coordinate system with a center point of the first hydraulic fracture unit body as an origin, a length direction of the hydraulic fracture as an X-axis, a direction passing through the origin and perpendicular to the wall surface of the hydraulic fracture as a Y-axis;

express the coordinates of the midpoint of the upper and lower natural fracture entrance unit bodies in the global coordinate system as:

$$\begin{cases} x_u = x_r + \dfrac{L}{R}\cos\omega \\ y_u = \dfrac{L}{N}\sin\omega \\ x_l = x_r - \dfrac{L}{R}\cos\omega \\ y_l = -\dfrac{L}{N}\sin\omega \end{cases};$$

wherein $\bar{x}_u$, $\bar{y}_u$ is a coordinate of the midpoint of the upper natural fracture entrance unit bodies in the global coordinate system; $\bar{x}_l$, $\bar{y}_l$ is a coordinate of the midpoint of the lower natural fracture entrance unit bodies in the global coordinate system; $\bar{x}_r$ is an abscissa of the point where the hydraulic fracture intersects the natural fracture in the global coordinate system; L is a total length of hydraulic fracture, meter; N is the divided number of unit bodies of the hydraulic fracture; $\omega$ is an angle between the hydraulic fracture and the natural fracture, degree;

express the coordinates of the midpoint of the upper and lower natural fracture entrance unit bodies in a local coordinate system based on the midpoint of the hydraulic fracture unit body i as:

$$\begin{cases} x_{ui} = \left(x_r + \dfrac{L}{N}\cos\omega - x_i\right)\cos\omega + \left(\dfrac{L}{N}\sin\omega - \bar{y}_i\right)\sin\omega \\ y_{ui} = -\left(x_r + \dfrac{L}{N}\cos\omega - x_i\right)\sin\omega + \left(\dfrac{L}{N}\sin\omega - \bar{y}_i\right)\cos\omega \\ x_{li} = \left(x_r - \dfrac{L}{N}\cos\omega - x_i\right)\cos\omega - \left(\dfrac{L}{N}\sin\omega + \bar{y}_i\right)\sin\omega \\ y_{li} = -\left(x_r - \dfrac{L}{N}\cos\omega - x_i\right)\sin\omega - \left(\dfrac{L}{N}\sin\omega + \bar{y}_i\right)\cos\omega \end{cases};$$

wherein $x_{ui}$, $y_{ui}$ is a coordinate of the midpoint of the upper natural fracture entrance unit bodies in the local coordinate system; $x_{li}$, $y_{li}$ is a coordinate of the midpoint of the lower natural fracture entrance unit bodies in the local coordinate system; $\bar{x}_i$, $\bar{y}_i$ is a coordinate of the unit body i of the hydraulic fracture in the global coordinate system; $\bar{x}_r$ an abscissa of the point where the hydraulic fracture intersects the natural fracture in the global coordinate system; L is a total length of hydraulic fracture, meter; N is the divided number of unit bodies of hydraulic fracture; $\omega$ is an angle between the hydraulic fracture and the natural fracture, degree; and place the above formula into the following formula for solution to obtain the shape coefficients of the upper and lower natural fracture entrance unit bodies with respect to the unit body i of the hydraulic fracture;

$$C^{ij}=2G[-f_1+y_{ij}(f_2 \sin 2\gamma^{ij}-f_3 \cos 2\gamma^{ij})];$$

$$\begin{cases} f_1 = \dfrac{1}{4\pi(1-\nu)}\left[\dfrac{x_{ij}-a}{(x_{ij}-a)^2+y_{ij}^2} - \dfrac{x_{ij}+a}{(x_{ij}+a)^2+y_{ij}^2}\right] \\ f_2 = \dfrac{l}{4\pi(1-\nu)}\left[\dfrac{(x_{ij}-a)^2-y_{ij}^2}{[(x_{ij}-a)^2+y_{ij}^2]^2} - \dfrac{(x_{ij}+a)^2-y_{ij}^2}{[(x_{ij}+a)^2+y_{ij}^2]^2}\right] \\ f_3 = \dfrac{2y}{4\pi(1-\nu)}\left[\dfrac{x_{ij}-a}{[(x_{ij}-a)^2+y_{ij}^2]^2} - \dfrac{x_{ij}+a}{[(x_{ij}+a)^2+y_{ij}^2]^2}\right] \end{cases}$$

wherein $\delta_j^k$ is a normal stress of the fracture unit body j at the k-th fraction of time, MPa; G is a shear modulus of the stratum rock, MPa; $\upsilon$ is the Poisson's ratio of the stratum rock, no factor; $d_{ij}$ is the distance between the midpoints of the fracture unit i and the fracture unit j, meter; H is a height of the hydraulic fracture, meter; $\alpha$, $\beta$ are empirical coefficients, taken $\alpha=1$, $\beta=2.3$; i, j is the number of the unit body of hydraulic fracture; $W_i^0$ is a width of the i-th unit body of hydraulic fracture at the initial time, meter; $C^{ij}$ is a shape coefficient of the fracture unit j with respect to the unit body i of the hydraulic fracture; $\gamma^{ij}$ is a deflection angle of the fracture unit body i with respect to the fracture unit body j; a is a half-length of the fracture unit body, that is, L/2N, meter; $x_{ij}$, $y_{ij}$ is a coordinate value of the midpoint of the fracture unit body j in the local coordinate system based on the midpoint of the fracture unit body i.

The present invention has the following advantages: the present invention is reliable in principle, high in calculation accuracy, and may accurately calculate the opening timing of natural fracture during the temporary plugging turnaround fracturing, further providing effective guidance for fracturing design.

BRIEF DESCRIPTION OF THE DRAWINGS

Aspects of the present invention are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DESCRIPTION OF THE PREFERRED EMBODIMENTS

Figure 1:
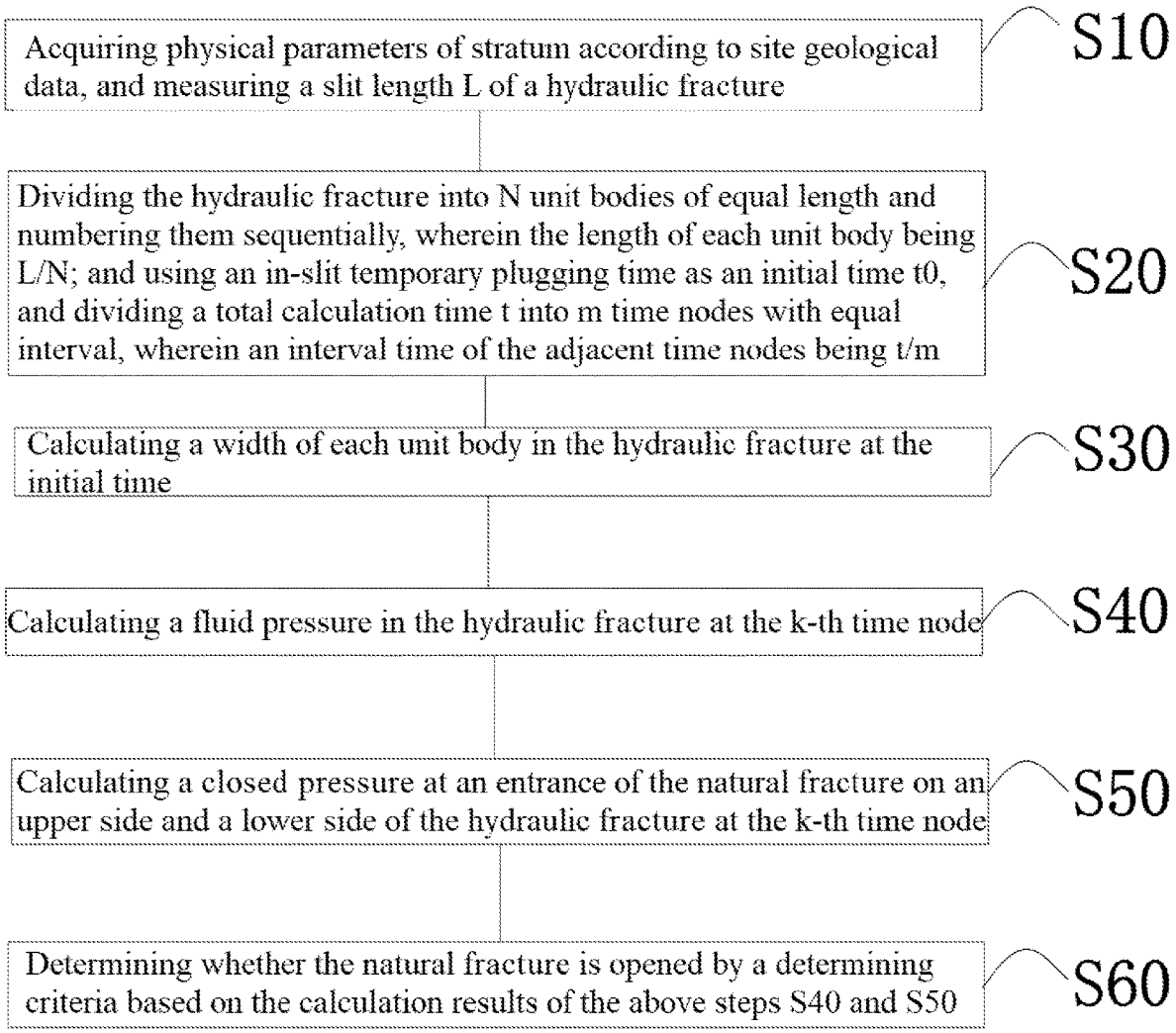
FIG. 1 is a flowchart of a method for acquiring an opening timing of natural fracture under an in-slit temporary plugging condition according to an embodiment of the present invention.

The following invention provides many different embodiments, or examples, for implementing different features of the provided subject matter. Specific examples of components and arrangements are described below to simplify the present invention. These are, of course, merely examples and are not intended to be limiting. For example, the stratum of a first feature over or on a second feature in the description that follows may include embodiments in which the first and second features are formed in direct contact, and may also include embodiments in which additional features may be formed between the first and second features, such that the first and second features may not be in direct contact. In addition, the present invention may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

Please refer to FIG. 1. FIG. 1 is a flowchart of a method for acquiring an opening timing of natural fracture under an in-slit temporary plugging condition according to an embodiment of the present invention. As shown in FIG. 1, the method for acquiring the opening timing of natural fracture under the in-slit temporary plugging condition includes the following steps.

Step S10: Acquiring physical parameters of stratum according to ae site geological data, and measuring a slit length L of a hydraulic fracture.

Step S20: Dividing the hydraulic fracture into N unit bodies of equal length and numbering them (N unit bodies of the hydraulic fracture) sequentially, i.e., the length of each unit body being L/N; and using an in-slit temporary plugging time as an initial time t0, and dividing a total calculation time t into meter fractions of time with the same interval, an interval time of the adjacent time nodes being t/m.

Step S30: Calculating a width of each unit body in the hydraulic fracture at the initial time according to the following formula (1);

$$P^0 - \sigma_h = \sum_{i=1}^{N} \frac{GN}{\pi L(1-\upsilon)} \left\{ 1 - \frac{d_{ij}^{\beta}}{[d_{ij}^2 + (H/\alpha)^2]^{\beta/2}} \right\} \left( \frac{1}{2j-2i+1} - \frac{1}{2j-2i+1} \right) W_i^0 \quad (j = 1, 2, \ldots, N); \tag{1}$$

wherein $p^0$ is a fluid pressure in the hydraulic fracture at the initial time t0, MPa; $\sigma_h$ is a minimum horizontal principal stress of the stratum, MPa; G is a shear modulus of the stratum rock, MPa; $\upsilon$ is the Poisson's ratio of the stratum rock, no factor; L is a total length of the hydraulic fracture, meter; N is the divided number of unit bodies of the hydraulic fracture; $d_{ij}$ is a distance between midpoints of the fracture unit body i and the fracture unit body j, meter; H is a height of the hydraulic fracture, meter; $\alpha$, $\beta$ are empirical coefficients, taken $\alpha=1$, $\beta=2.3$; i, j is the number of the unit body of the hydraulic fracture; $W_i^0$ is a width of the i-th unit body of the hydraulic fracture at the initial time, meter.

Step S40: Calculating a fluid pressure in the hydraulic fracture at the k-th fraction of time, which specifically includes the following sub-steps:

Sub-step S401: Calculating an estimated fluid pressure in the hydraulic fracture at the k-th fraction of time according to the following formula (2);

$$\begin{cases} \hat{p}^k = p^0 & (k = 1) \\ \hat{p}^k = 1.25 p^{k-1} & (k > 1) \end{cases}; \tag{2}$$

wherein $p^0$ is the fluid pressure in the hydraulic fracture at the initial time, MPa; $p^{k-1}$ is an actual fluid pressure in the hydraulic fracture at the (k−1)-th fraction of time; $\hat{p}^k$ is an estimated fluid pressure in the hydraulic fracture at the k-th fraction of time, MPa.

Sub-step S402: Calculating an estimated width of each unit body of the hydraulic fracture at the k-th fraction of time according to the estimated fluid pressure calculated above and the following formula (3);

$$\hat{P}^k - \sigma_h = \sum_{i=1}^{N} \frac{GN}{\pi L(1-\upsilon)} \left\{ 1 - \frac{d_{ij}^{\beta}}{[d_{ij}^2 + (H/\alpha)^2]^{\beta/2}} \right\} \left( \frac{1}{2j-2i+1} - \frac{1}{2j-2i+1} \right) \hat{W}_i^k \ (j = 1, 2, \ldots, N); \tag{3}$$

wherein $\hat{p}^k$ is an estimated fluid pressure in the hydraulic fracture at the k-th fraction of time, MPa; $\sigma_h$ is a minimum horizontal principal stress of the stratum, MPa; G is a shear modulus of the stratum rock, MPa; $\upsilon$ is the Poisson's ratio of the stratum rock, no factor; L is a total length of hydraulic fracture, meter; N is the divided number of unit bodies of the hydraulic fracture; $d_{ij}$ is the distance between the midpoints of the fracture unit body i and the fracture unit body j, meter; H is a height of the hydraulic fracture, meter; $\alpha$, $\beta$ are empirical coefficients, taken $\alpha$=1, $\beta$=2.3; i, j is the number of the unit body of hydraulic fracture; $\hat{W}_i^k$ is an estimated width of each unit body of the hydraulic fracture at the k-th fraction of time, meter.

Sub-step S403: Calculating an error $\alpha$ of the estimated width by the following formula (4);

$$\alpha = \frac{HL\left(\sum_{i=1}^{N} \hat{W}_i^k - \sum_{i=1}^{N} W_i^{k-1}\right)}{NQ\Delta t}; \tag{4}$$

wherein $\hat{W}_i^k$ is an estimated width of each unit of the hydraulic fracture at the k-th fraction of time, meter; $\hat{W}_i^{k-1}$ is an estimated width of each unit of the hydraulic fracture at the (k−1)-th fraction of time, meter; H is the height of the hydraulic fracture, meter; L is the total length of the hydraulic fracture, meter; N is the divided number of unit bodies of the hydraulic fracture; Q is the pumping displacement of fracturing fluid after in-slit temporary plugging, m3/s; $\Delta t$ is an interval time of adjacent fractions of time, s; i is the number of unit bodies of the hydraulic fracture; $\alpha$ is the error.

Sub-step S404: Setting solution accuracy $\varepsilon$, and comparing the error $\alpha$ obtained above with the solution accuracy $\varepsilon$.

The solution accuracy is generally 5%, and the solution accuracy depends mainly on the accuracy of the results in the solution process; the closer the fracture width is to the true value, the smaller the error $\alpha$ is; and if the solution accuracy value is not satisfied by the error $\alpha$ obtained, iterating is required to be continued.

If $\alpha \le \varepsilon$, $\hat{P}^k$ and $\hat{W}_i^k$ calculated in step S402 and step S403 are respectively the fluid pressure in the hydraulic fracture at the k-th fraction of time and the width of each unit body; if $\alpha > \varepsilon$, then re-estimating the fluid pressure using the following formula (5) and repeating steps S402-S404 until $\beta \le \varepsilon$ is satisfied;

$$\begin{cases} \hat{p}^k = \dfrac{\hat{P}^k}{1+10\alpha} & (\alpha > 0) \\ \hat{p}^k = (1-10\alpha)\hat{P}^k & (\alpha < 0) \end{cases}; \tag{5}$$

wherein $\varepsilon$ is a solution accuracy; $\hat{p}^k$ is an estimated fluid pressure in the hydraulic fracture at the k-th fraction of time, MPa; $\alpha$ is an error.

Step S50: Calculating a closed pressure at the entrance of the natural fracture on the upper and lower sides of the hydraulic fracture at the k-th fraction of time by the following formula (6);

$$\begin{cases} \sigma_u^k = \left(\dfrac{\sigma_H + \sigma_h}{2} - \dfrac{\sigma_H - \sigma_h}{2}\cos 2\omega\right) + \displaystyle\sum_{i=1}^{N} \left\{ 1 - \frac{d_{ui}^{\beta}}{[d_{ui}^2 + (H/\alpha)^2]^{\beta/2}} \right\} C^{m} W_i^k \\ \sigma_l^k = \left(\dfrac{\sigma_H + \sigma_h}{2} - \dfrac{\sigma_H - \sigma_h}{2}\cos 2\omega\right) + \displaystyle\sum_{i-1}^{N} \left\{ 1 - \frac{d_{li}^{\beta}}{[d_{li}^2 + (H/\alpha)^2]^{\beta/2}} \right\} C^{li} W_i^k \end{cases}; \tag{6}$$

wherein $\sigma_u^k$ is the closed pressure at the entrance of the natural fracture on the upper side of the hydraulic fracture at the k-th fraction of time, MPa; $\sigma_l^k$ is the closed pressure at the entrance of the natural fracture on the lower side of the hydraulic fracture at the k-th fraction of time, MPa; $\sigma_H$ is a maximum horizontal principal stress of the stratum, MPa; $\sigma_h$ is a minimum horizontal principal stress of the stratum, MPa; $\omega$ is an angle between the hydraulic fracture and the natural fracture; $d_{ui}$ is a distance between the midpoint of the upper natural fracture entrance unit and the midpoint of the hydraulic fracture unit i, meter; $d_{li}$ is a distance between the midpoint of the lower natural fracture entrance unit and the midpoint of the hydraulic fracture unit i, meter; H is a height of the hydraulic fracture, meter; $\alpha$, $\beta$ is an empirical coefficient, taken $\alpha$=1, $\beta$=2.3; $W_i^k$ is a width of the unit body i of the hydraulic fracture at the k-th fraction of time, meter; $C^{ui}$, $C^{li}$ are the shape coefficients of the upper and lower natural fracture entrance unit bodies with respect to the unit body i of the hydraulic fracture, respectively.

The shape coefficients of the upper and lower natural fracture entrance unit bodies with respect to the unit body i of the hydraulic fracture are obtained by the following sub-steps.

Sub-step S501: Establishing a global coordinate system with a center point of the first hydraulic fracture unit body as an origin, a length direction of the hydraulic fracture as an X-axis, a direction passing through the origin and perpendicular to the wall surface of the hydraulic fracture as a Y-axis.

Sub-step S502: Expressing the coordinates of the midpoint of the upper and lower natural fracture entrance unit bodies in the global coordinate system as:

$$\begin{cases} x_u = x_r + \dfrac{L}{N} \cos\omega \\ y_u = \dfrac{L}{N} \sin\omega \\ x_l = x_r - \dfrac{L}{N} \cos\omega \\ y_l = -\dfrac{L}{N} \sin\omega \end{cases};$$

wherein $\bar{x}_u$, $\bar{y}_u$ is a coordinate of the midpoint of the upper natural fracture entrance unit bodies in the global coordinate system; $\bar{x}_l$, $\bar{y}_l$ is a coordinate of the midpoint of the lower natural fracture entrance unit bodies in the global coordinate system; $\bar{x}_r$ an abscissa of the point where the hydraulic fracture intersects the natural fracture in the global coordinate system; L is a total length of hydraulic fracture, meter; N is the divided number of unit bodies of the hydraulic fracture; ω is an angle between the hydraulic fracture and the natural fracture, degree.

Sub-step S503: Expressing the coordinates of the midpoint of the upper and lower natural fracture entrance unit bodies in a local coordinate system based on the midpoint of the hydraulic fracture unit body i as the following formula (7):

$$\begin{cases} x_{ui} = \left(x_r + \frac{L}{N}\cos\omega - x_i\right)\cos\omega + \left(\frac{L}{N}\sin\omega - \bar{y}_i\right)\sin\omega \\ y_{ui} = -\left(x_r + \frac{L}{N}\cos\omega - x_i\right)\sin\omega + \left(\frac{L}{N}\sin\omega - \bar{y}_i\right)\cos\omega \\ x_{li} = \left(x_r - \frac{L}{N}\cos\omega - x_i\right)\cos\omega - \left(\frac{L}{N}\sin\omega - \bar{y}_i\right)\sin\omega \\ y_{li} = -\left(x_r - \frac{L}{N}\cos\omega - x_i\right)\sin\omega - \left(\frac{L}{N}\sin\omega - \bar{y}_i\right)\cos\omega \end{cases}; \tag{7}$$

wherein $x_{ui}$, $y_{ui}$ is a coordinate of the midpoint of the upper natural fracture entrance unit bodies in the local coordinate system; $x_{li}$, $y_{li}$ is a coordinate of the midpoint of the lower natural fracture entrance unit bodies in the local coordinate system; $\bar{x}_i$, $\bar{y}_i$ is a coordinate of the unit body i of the hydraulic fracture in the global coordinate system; $\bar{x}_r$ an abscissa of the point where the hydraulic fracture intersects the natural fracture in the global coordinate system; L is a total length of hydraulic fracture, meter; N is the divided number of unit bodies of hydraulic fracture; ω is an angle between the hydraulic fracture and the natural fracture, degree.

Sub-step S504: Placing the obtained coordinates of the midpoint of the upper and lower natural fracture entrance unit bodies in a local coordinate system in formula (7) in sub-step (S503) into the following formula (8) for solution to obtain the shape coefficients of the upper and lower natural fracture entrance unit bodies with respect to the unit body i of the hydraulic fracture;

$$C^{ij}=2G[-f_1+y_{ij}(f_2 \sin 2\gamma^{ij}-f_3 \cos 2\gamma^{ij})];$$

$$\begin{cases} f_1 = \frac{1}{4\pi(1-\nu)}\left[\frac{x_{ij}-a}{(x_{ij}-a)^2+y_{ij}^2} - \frac{x_{ij}+a}{(x_{ij}+a)^2+y_{ij}^2}\right] \\ f_2 = \frac{1}{4\pi(1-\nu)}\left[\frac{(x_{ij}-a)^2-y_{ij}^2}{[(x_{ij}-a)^2+y_{ij}^2]^2} - \frac{(x_{ij}+a)^2-y_{ij}^2}{[(x_{ij}+a)^2+y_{ij}^2]^2}\right] \\ f_3 = \frac{2y}{4\pi(1-\nu)}\left[\frac{x_{ij}-a}{[(x_{ij}-a)^2+y_{ij}^2]^2} - \frac{x_{ij}+a}{[(x_{ij}+a)^2+y_{ij}^2]^2}\right] \end{cases}; \tag{8}$$

wherein $\delta_j^k$ is a normal stress of the fracture unit body j at the k-th fraction of time, MPa; G is a shear modulus of the stratum rock, MPa; υ is the Poisson's ratio of the stratum rock, no factor; $d_{ij}$ is the distance between the midpoints of the fracture unit i and the fracture unit j, meter; H is a height of the hydraulic fracture, meter; α, β are empirical coefficients, taken α=1, β=2.3; i, j is the number of the unit body of hydraulic fracture; $W_i^0$ is a width of the i-th unit body of hydraulic fracture at the initial time, meter; $C^{ij}$ is a shape coefficient of the fracture unit j with respect to the unit body i of the hydraulic fracture; $\gamma^{ij}$ is a deflection angle of the fracture unit body i with respect to the fracture unit body j; a is a half-length of the fracture unit body, that is, L/2N, meter; $x_{ij}$, $y_{ij}$ is a coordinate value of the midpoint of the fracture unit body j in the local coordinate system based on the midpoint of the fracture unit body i.

Step S60: Determining whether the natural fracture is opened by the following determining criteria based on the calculation results of the above steps S40 and S50.

If yes, the time $$t_0 + \frac{kt}{m}$$

corresponding to the fraction of time k is the opening time of the natural fracture;

if not, then letting k=k+1, repeating steps S40-S50 until the natural fracture is opened or the temporary plugging section fails.

The determining criteria include:

if $P^k>\sigma_u^k$, the upper side of the natural fracture is opened;

if $P^k<\sigma_l^k$, the lower side of the natural fracture is opened;

if $P^k>P_c+P_r$, the temporary plugging section fails;

wherein $P^k$ is a fluid pressure in the hydraulic fracture at the k-th fraction of time; $\sigma_u^k$ is the closed pressure at the entrance of the natural fracture on the upper side of the hydraulic fracture at the k-th fraction of time, MPa; $\sigma_l^k$ is the closed pressure at the entrance of the natural fracture on the lower side of the hydraulic fracture at the k-th fraction of time, MPa; $P_c$ is a plugging strength of the temporary plugging section, MPa; $P_r$ is a fluid pressure of the stratum, MPa.

The calculation formula for the width of each unit body in the hydraulic fracture at the initial time in the present embodiment is obtained according to the following steps:

1) The relationship between the width of each unit body of the hydraulic fracture and its internal fluid pressure at initial time may be expressed as the following formulas (9), (10), (11):

$$\delta_j^k = \sum_{i=1}^{N}\left\{1 - \frac{d_{ij}^{\beta}}{[d_{ij}^2 + (H/\alpha)^2]^{\beta/2}}\right\}C^{ij}W_i^0 (j = 1, 2, \ldots, N); \tag{9}$$

$$C^{ij}=2G[-f_1+y_{ij}(f_2 \sin 2\gamma^{ij}-f_3 \cos 2\gamma^{ij})] \tag{10};$$

$$\begin{cases} f_1 = \frac{1}{4\pi(1-\nu)}\left[\frac{x_{ij}-a}{(x_{ij}-a)^2+y_{ij}^2} - \frac{x_{ij}+a}{(x_{ij}+a)^2+y_{ij}^2}\right] \\ f_2 = \frac{1}{4\pi(1-\nu)}\left[\frac{(x_{ij}-a)^2-y_{ij}^2}{[(x_{ij}-a)^2+y_{ij}^2]^2} - \frac{(x_{ij}+a)^2-y_{ij}^2}{[(x_{ij}+a)^2+y_{ij}^2]^2}\right] \\ f_3 = \frac{2y}{4\pi(1-\nu)}\left[\frac{x_{ij}-a}{[(x_{ij}-a)^2+y_{ij}^2]^2} - \frac{x_{ij}+a}{[(x_{ij}+a)^2+y_{ij}^2]^2}\right] \end{cases}; \tag{11}$$

wherein $\delta_j^k$ is a normal stress of the fracture unit body j at the k-th fraction of time, MPa; G is a shear modulus of the stratum rock, MPa; υ is the Poisson's ratio of the stratum rock, no factor; $d_{ij}$ is the distance between the midpoints of the fracture unit body i and the fracture unit body j, meter; H is a height of the hydraulic fracture, meter; α, β are empirical coefficients, taken α=1, β=2.3; i, j is the number of the unit body of hydraulic fracture; $W_i^0$ is a width of the i-th unit body of hydraulic fracture at the initial time, meter; $C^{ij}$ is a shape coefficient of the fracture unit body j with respect to the unit body i of the hydraulic fracture; $\gamma^{ij}$ is a deflection angle of the fracture unit body i with respect to the fracture unit body j; a is a half-length of the fracture unit body (i.e., L/2N), meter; $x_{ij}$, $y_{ij}$ is a coordinate value of the midpoint of the fracture unit body j in the local coordinate system based on the midpoint of the fracture unit body i; the local coordinate system taking a midpoint of the fracture unit body i as the origin, a length direction of the fracture as the X axis, and a direction perpendicular to the fracture wall surface as the Y axis.

2) Since the hydraulic fracture tends to extend perpendicular to the direction of the minimum horizontal principal stress, and the fracture unit body j may be externally subjected to the minimum horizontal principal stress and may be subjected to fluid pressure inside, the normal stress received may be expressed as the following formula (12):

$$\delta_n^k = P^0 - \sigma_h \quad (12);$$

wherein $p^0$ is a fluid pressure in the hydraulic fracture at the initial time, determined by the actual pumping process of the temporary plugging agent, MPa; $\sigma_h$ is a minimum horizontal principal stress of the stratum, MPa.

3) A global two-dimensional Cartesian coordinate system is established with a center point of the first hydraulic fracture unit as an origin, a length direction of the hydraulic fracture as an X-axis, a direction passing through the origin and perpendicular to the wall surface of the hydraulic fracture as a Y-axis; based on this coordinate system, the coordinate of the midpoint of the i-th hydraulic fracture unit body may be expressed as the following formula (13):

$$\begin{cases} x_i = \dfrac{(i-1)L}{N} \\ y_i = 0 \end{cases}; \quad (13)$$

wherein $\bar{x}_i$, $\bar{y}_i$ is a coordinate value of the fracture unit body i in the global coordinate system; i is a number of the fracture unit body; L is a total length of hydraulic fracture, meter; N is the divided number of unit bodies of the hydraulic fracture.

4) According to the law between the local coordinates and the global coordinates, the coordinate of the midpoint of the fracture unit body j in the local coordinate system based on the midpoint of the fracture unit body i may be expressed as the following formula (14):

$$\begin{cases} x_{ij} = \dfrac{(j-1)L}{N} - \dfrac{(i-1)L}{N} = (j-i)\dfrac{L}{N} \\ y_{ij} = 0 \end{cases}; \quad (14)$$

wherein $x_{ij}$, $y_{ij}$ is a coordinate value of the midpoint of the fracture unit body j in the local coordinate system based on the midpoint of the fracture unit body i; i, j is a number of the fracture unit body; L is a total length of hydraulic fracture, meter; N is the divided number of unit bodies of the hydraulic fracture.

5) Substituting formula (12) into formula (9), and substituting formula (14) into formula (10) and formula (11), which may obtain a relationship formula (15) between the width $W_i^0$ of each unit body of the hydraulic fracture and its internal fluid pressure at initial time as follow:

$$P^0 - \sigma_h = \sum_{i=1}^{N} \frac{GN}{\pi L(1-\nu)} \left\{ 1 - \frac{d_{ij}^{\beta}}{[d_{ij}^2 + (H/\alpha)^2]^{\beta/2}} \right\} \quad (15)$$

-continued $$\left( \frac{1}{2j-2i+1} - \frac{1}{2j-2i+1} \right) W_i^0 \ (j = 1, 2, \ldots N).$$

In the present embodiment, the calculation formula for the closed pressure at the entrance of the natural fracture on the upper and lower sides of the hydraulic fracture at the k-th fraction of time is obtained by the following steps:

First, the upper and lower natural fracture of the hydraulic fracture refer to the two wings of the same natural fracture, the hydraulic fracture generally passes through the middle part of the natural fracture to divide the original continuous natural fracture into two, and the two wings of the natural fracture are located on both sides of the hydraulic fracture (here distinguished by the upper side and the lower side). When the hydraulic fracture is orthogonal to the natural fracture, the natural fracture on both sides may be simultaneously opened according to the symmetry; when the hydraulic fracture is not orthogonal to the natural fracture, the natural fracture on both sides have a sequence of opening, so in determining the opening timing of natural fracture after temporary plugging, it is also necessary to simultaneously determine which side of the natural fracture is preferentially opened, which is very important for determining the opening timing of natural fracture.

Similarly, in order to ensure the uniformity of calculation and the need to adapt to numerical solutions, the natural fracture on both sides may also be considered to consist of multiple unit bodies of length L/N, but the calculation process is only performed for the first unit body at the entrance to the natural fracture on both sides. In addition, there are a large number of natural fracture around the hydraulic fracture. Here, the case of existing only one natural fracture is used as an example to illustrate the solution process. When there are multiple natural fracture, the overall calculation method is similar.

Second, the closed pressure of natural fracture refers to the force that forces the natural fracture to remain closed, and may be divided into two parts, namely, a stratum normal stress and a hydraulic fracture induced stress, wherein the stratum normal stress may be expressed as the following formula (16):

$$\varphi_n^k = \frac{\sigma_H + \sigma_h}{2} - \frac{\sigma_H - \sigma_h}{2} \cos 2\omega; \quad (16)$$

wherein $\varphi_n^k$ a normal stress of the stratum acting on the wall surface of the natural fracture, MPa; the force of the stratum acting on natural fracture may be divided into a normal stress and a shear stress, wherein only the normal stress may force the natural fracture to close.

$\sigma_h$—Maximum horizontal principal stress of stratum, MPa;

$\sigma_h$—Minimum horizontal principal stress of stratum, MPa;

$\omega$—Angle between the hydraulic fracture and the natural fracture, degree.

The hydraulic fracture induced stress is still expressed by the formula (15), and the formula (15) is superposed with the formula (16) to obtain the following formula (17):

$$\begin{cases} \sigma_u^k = \left(\frac{\sigma_H + \sigma_h}{2} - \frac{\sigma_H - \sigma_h}{2}\cos 2\omega\right) + \\ \sum_{i=1}^{N}\left\{1 - \frac{d_{ui}^{\beta}}{[d_{ui}^2 + (H/\alpha)^2]^{\beta/2}}\right\} C^{ui} W_i^k \\ \sigma_l^k = \left(\frac{\sigma_H + \sigma_h}{2} - \frac{\sigma_H - \sigma_h}{2}\cos 2\omega\right) + \\ \sum_{i=1}^{N}\left\{1 - \frac{d_{li}^{\beta}}{[d_{li}^2 + (H/\alpha)^2]^{\beta/2}}\right\} C^{li} W_i^k \end{cases}; \quad (17)$$

wherein $\sigma_u^k$ is a closed pressure at the natural fracture entrance on the upper side of the hydraulic fracture at the k-th fraction of time, MPa; $\sigma_l^k$ is a closed pressure at the natural fracture entrance on the lower side of the hydraulic fracture at the k-th fraction of time, MPa; $\sigma_H$ is a maximum horizontal principal stress of the stratum, MPa; $\sigma_h$ is a minimum horizontal principal stress of the stratum, MPa; ω is an angle between the hydraulic fracture and the natural fracture; $d_{ui}$ is a distance between the midpoint of the upper natural fracture entrance unit and the midpoint of the hydraulic fracture unit i, meter; $d_{li}$ is a distance between the midpoint of the lower natural fracture entrance unit and the midpoint of the hydraulic fracture unit i, meter; H is a height of the hydraulic fracture, meter; α, β is an empirical coefficient, taken α=1, β=2.3; $W_i^k$ is a width of the unit body i of the hydraulic fracture at the k-th fraction of time, meter; $C^{ui}$, $C^{li}$ are the shape coefficients of the upper and lower natural fracture entrance unit bodies with respect to the unit body i of the hydraulic fracture, respectively.

Figure 2:
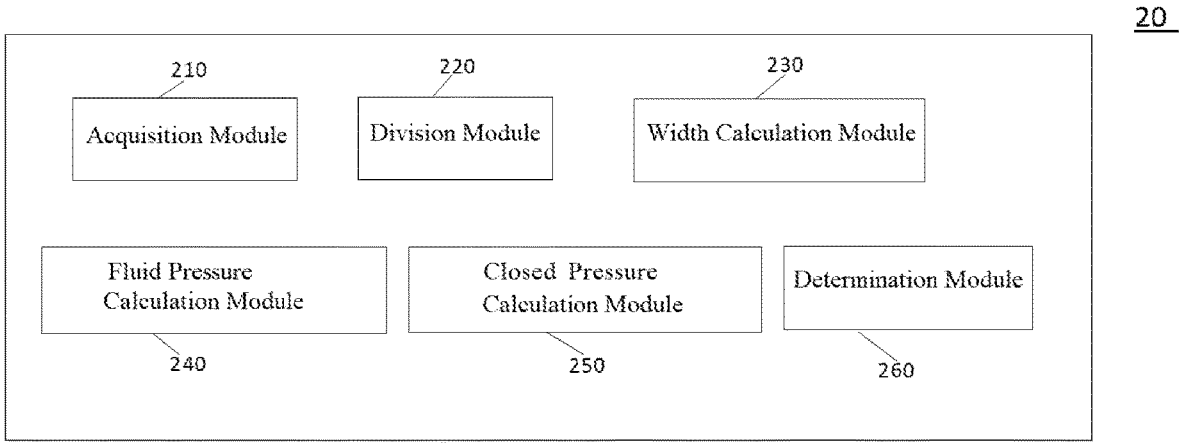
FIG. 2 is a block diagram of a device for acquiring an opening timing of natural fracture under an in-slit temporary plugging condition according to an embodiment of the present invention.

Please refer to FIG. 2. FIG. 2 is a block diagram of a device 200 for acquiring an opening timing of natural fracture under an in-slit temporary plugging condition according to an embodiment of the present invention. As shown in FIG. 2, the device 200 includes an acquisition module 210, a division module 220, a width calculation module 230, a fluid pressure calculation module 240, a closed pressure calculation module 250, and a determination module 260. The acquisition module 210 is configured to acquire physical parameters of stratum according to site geological data, and measure a slit length L of a hydraulic fracture. The division module 220 is configured to divide the hydraulic fracture into N unit bodies of equal length and number them sequentially, wherein the length of each unit body being L/N; and use an in-slit temporary plugging time as an initial time t0, and divide a total calculation time t into meter time nodes with equal interval, wherein an interval time of the adjacent fractions of time being t/m. The width calculation module 230 is configured to calculate a width of each unit body in the hydraulic fracture at the initial time. The fluid pressure calculation module 240 is configured to calculate a fluid pressure in the hydraulic fracture at the k-th fraction of time. The closed pressure calculation module 250 is configured to calculate a closed pressure at an entrance of the natural fracture on an upper side and a lower side of the hydraulic fracture at the k-th fraction of time. The determination module 260 is configured to determine whether the natural fracture is opened by a determining criteria based on calculation results of the fluid pressure calculation module and the closed pressure calculation module. If yes, the time $$t_0 + \frac{kt}{m}$$

corresponding to the fraction of time k is the opening time of the natural fracture; if not, then letting k=k+1, repeating steps S40-S50 until the natural fracture is opened or the temporary plugging section fails.

The determining criteria include:

if $P^k > \sigma_u^k$, the upper side of the natural fracture is opened;

if $P^k < \sigma_l^k$, the lower side of the natural fracture is opened;

if $P^k > P_c + P_r$, the temporary plugging section fails;

wherein $P^k$ is a fluid pressure in the hydraulic fracture at the k-th fraction of time; $\sigma_u^k$ is the closed pressure at the entrance of the natural fracture on the upper side of the hydraulic fracture at the k-th fraction of time, MPa; $\sigma_l^k$ is the closed pressure at the entrance of the natural fracture on the lower side of the hydraulic fracture at the k-th fraction of time, MPa; $P_c$ is a plugging strength of the temporary plugging section, MPa; $P_r$ is a fluid pressure of the stratum, MPa.

The beneficial effects of the present invention are as follows: in the present invention, combined with the fractal geometry theory, the fracture complexity coefficient of shale rocks is redefined and calculated to accurately characterize the rock fracture morphology, so that the characteristics of rock fracture morphology may be correctly understood and the affecting factors of fracture morphology may be analyzed.

By adopting the method for acquiring an opening timing of natural fracture under an in-slit temporary plugging condition and the device thereof of the present invention, the development of gas (oil) reservoir layers of shale rocks can be improved, and the reach range of production wells and the permeability of gas (oil) reservoir layers can be increased. Therefore, gas (oil) production of shale rocks can be improved, and production costs can be reduced, so as to achieve commercial scale development.

The foregoing outlines features of several embodiments so that those skilled in the art may better understand the aspects of the present invention. Those skilled in the art should appreciate that they may readily use the present invention as a basis for designing or modifying other processes and structures for carrying out the same purposes and/or achieving the same advantages of the embodiments introduced herein. Those skilled in the art should also realize that such equivalent constructions do not depart from the spirit and scope of the present invention, and that they may make various changes, substitutions, and alterations herein without departing from the spirit and scope of the present invention.

What is claimed is:

1. A method for acquiring an opening timing of natural fracture under an in-slit temporary plugging condition, applied to hydraulic fracturing in oil and gas exploration and development, comprising:

step S10: an acquisition module acquiring physical parameters of stratum according to site geological data, and measuring a slit length L of a hydraulic fracture;

step S20: dividing the hydraulic fracture into N unit bodies of equal length and numbering them sequentially, wherein the length of each unit body being L/N; and using an in-slit temporary plugging time as an initial time t0, and dividing a total calculation time t into m fractions of time with equal interval, wherein an interval time of the adjacent fractions of time being t/m;

step S30: calculating a width of each unit body in the hydraulic fracture at the initial time;

step S40: calculating a fluid pressure in the hydraulic fracture at the k-th fraction of time;

step S50: calculating a closed pressure at an entrance of the natural fracture on an upper side and a lower side of the hydraulic fracture at the k-th fraction of time;

step S55: providing a temporary plugging agent to artificially restricting a hydraulic fracture tip to extend forward and forcing a sharp rise in the fluid pressure for opening the natural fracture; and Step S60: determining whether the natural fracture is opened by a determining criteria based on the calculation results of the above steps S40 and S50;

if yes, the time $$t_0 + kt/m$$

corresponding to the fraction of time k is the opening time of the natural fracture;

if not, then letting k=k+1, repeating steps S40-S50 until the natural fracture is opened or the temporary plugging section fails;

the determining criteria include:

if a fluid pressure in the hydraulic fracture at the k-th fraction of time is greater than the closed pressure at the entrance of the natural fracture on the upper side of the hydraulic fracture at the k-th fraction of time, the upper side of the natural fracture is opened;

if the fluid pressure in the hydraulic fracture at the k-th fraction of time is less than the closed pressure at the entrance of the natural fracture on the lower side of the hydraulic fracture at the k-th fraction of time, the lower side of the natural fracture is opened;

if the fluid pressure in the hydraulic fracture at the k-th fraction of time is greater than a plugging strength of the temporary plugging section and a fluid pressure of the stratum being combined, the temporary plugging section fails;

wherein a calculation formula in the step S30 is:

$$P^0 - \sigma_h = \sum_{i=1}^{N} \frac{GN}{\pi L(1-\upsilon)} \left\{ 1 - \frac{d_{ij}^{\beta}}{[d_{ij}^2 + (H/\alpha)^2]^{\beta/2}} \right\} \left( \frac{1}{2j-2i+1} - \frac{1}{2j-2i+1} \right) W_i^0 (j = 1, 2, \ldots N);$$

wherein $p^0$ is a fluid pressure in the hydraulic fracture at the initial time t0, MPa; $\sigma_h$ is a minimum horizontal principal stress of the stratum, MPa; G is a shear modulus of a stratum rock, MPa; $\upsilon$ is the Poisson's ratio of the stratum rock, no factor; L is a total length of hydraulic fracture, meter; N is the divided number of unit bodies of the hydraulic fracture; $d_{ij}$ is a distance between the midpoints of the fracture unit body i and the fracture unit body j, meter; H is a height of the hydraulic fracture, meter; $\alpha$, $\beta$ are empirical coefficients, taken $\alpha$=1, $\beta$=2.3; i, j is the number of the unit body of the hydraulic fracture; $W_i^0$ is a width of the i-th unit body of the hydraulic fracture at the initial time, meter, thereby the method for acquiring the opening timing of natural fracture under the in-slit temporary plugging condition applied to hydraulic fracturing facilitate increase in fracturing range and increasing the reach range of production wells.

2. The method for acquiring an opening timing of natural fracture under an in-slit temporary plugging condition in claim 1, wherein the step S40 includes the following substeps:

sub-step S401: calculating an estimated fluid pressure in the hydraulic fracture at the k-th fraction of time according to the following formula:

$$\begin{cases} \hat{p}^k = p^0 (k = 1) \\ \hat{p}^k = 1.25 p^{k-1} (k > 1) \end{cases};$$

wherein $p^0$ is the fluid pressure in the hydraulic fracture at the initial time, MPa; $p^{k-1}$ is an actual fluid pressure in the hydraulic fracture at the (k−1)-th fraction of time; $\hat{p}^k$ is an estimated fluid pressure in the hydraulic fracture at the k-th fraction of time, MPa;

sub-step S402: calculating an estimated width of each unit body of the hydraulic fracture at the k-th fraction of time according to the estimated fluid pressure calculated above and the following formula:

$$\hat{p}^k - \sigma_h = \sum_{i=1}^{N} \frac{GN}{\pi L(1-\upsilon)} \left\{ 1 - \frac{d_{ij}^{\beta}}{[d_{ij}^2 + (H/\alpha)^2]^{\beta/2}} \right\} \left( \frac{1}{2j-2i+1} - \frac{1}{2j-2i+1} \right) \hat{W}_i^k (j = 1, 2, \ldots N);$$

wherein $\hat{p}^k$ is an estimated fluid pressure in the hydraulic fracture at the k-th fraction of time, MPa; $\sigma_h$ is a minimum horizontal principal stress of the stratum, MPa; G is a shear modulus of a stratum rock, MPa; $\upsilon$ is the Poisson's ratio of the stratum rock, no factor; L is a total length of hydraulic fracture, meter; N is the divided number of unit bodies of the hydraulic fracture; $d_{ij}$ is a distance between the midpoints of the fracture unit body i and the fracture unit body j, meter; H is a height of the hydraulic fracture, meter; $\alpha$, $\beta$ are empirical coefficients, taken $\alpha$=1, $\beta$=2.3; i, j is the number of the unit body of hydraulic fracture; $\hat{W}_i^k$ is an estimated width of each unit body of the hydraulic fracture at the k-th fraction of time, meter;

sub-step S403: calculating an error $\alpha$ of the estimated width by the following formula:

$$\alpha = \frac{HL\left( \sum_{i=1}^{N} \hat{W}_i^k - \sum_{i=1}^{N} W_i^{k-1} \right)}{NQ\Delta t};$$

wherein $\hat{W}_i^k$ is an estimated width of each unit of the hydraulic fracture at the k-th fraction of time, meter; $W_i^{k-1}$ is an estimated width of each unit of the hydraulic fracture at the (k−1)-th fraction of time, meter; H is a height of the hydraulic fracture, meter; L is a total length of the hydraulic fracture, meter; N is the divided number of unit bodies of the hydraulic fracture; Q is a pumping displacement of fracturing fluid after in-slit temporary plugging, m3/s; $\Delta t$ is an interval time of adjacent fractions of time, s; i is the number of unit bodies of the hydraulic fracture; $\alpha$ is the error;

sub-step S404: setting solution accuracy ε, and comparing the error α obtained above with the solution accuracy ε;

if α≤ε, $\hat{P}^k$ and $\hat{W}_i^k$ calculated in step S402 and step S403 are respectively the fluid pressure in the hydraulic fracture at the k-th fraction of time and the width of each unit body; if α>ε, then re-estimating the fluid pressure using the following formula and repeating steps S402-S404 until α≤ε is satisfied;

$$\begin{cases} \hat{P}^k = \dfrac{\hat{P}^k}{1+10\alpha}\ (\alpha > 0) \\ \hat{P}^k = (1-10\alpha)\hat{P}^k\ (\alpha < 0) \end{cases};$$

wherein ε is a solution accuracy; $\hat{p}^k$ is an estimated fluid pressure in the hydraulic fracture at the k-th fraction of time, MPa; α is an error.

3. The method for acquiring an opening timing of natural fracture under an in-slit temporary plugging condition in claim 1, wherein a calculation formula in the step S50 is:

$$\begin{cases} \sigma_u^k = \left(\dfrac{\sigma_H+\sigma_h}{2} - \dfrac{\sigma_H-\sigma_h}{2}\cos 2\omega\right) + \\ \displaystyle\sum_{i=1}^{N}\left\{1 - \frac{d_{ui}^{\beta}}{[d_{ui}^2 + (H/\alpha)^2]^{\beta/2}}\right\} C^{ui} W_i^k \\ \sigma_l^k = \left(\dfrac{\sigma_H+\sigma_h}{2} - \dfrac{\sigma_H-\sigma_h}{2}\cos 2\omega\right) + \\ \displaystyle\sum_{i=1}^{N}\left\{1 - \frac{d_{li}^{\beta}}{[d_{li}^2 + (H/\alpha)^2]^{\beta/2}}\right\} C^{li} W_i^k \end{cases};$$

wherein $\sigma_u^k$ is a closed pressure at an entrance of the natural fracture on an upper side of the hydraulic fracture at the k-th fraction of time, MPa; $\sigma_l^k$ is a closed pressure at an entrance of the natural fracture on a lower side of the hydraulic fracture at the k-th fraction of time, MPa; $\sigma_H$ is a maximum horizontal principal stress of the stratum, MPa; $\sigma_h$ is a minimum horizontal principal stress of the stratum, MPa; ω is an angle between the hydraulic fracture and the natural fracture; $d_{ui}$ is a distance between the midpoint of the upper natural fracture entrance unit and the midpoint of the hydraulic fracture unit i, meter; $d_{li}$ is a distance between the midpoint of the lower natural fracture entrance unit and the midpoint of the hydraulic fracture unit i, meter; H is a height of the hydraulic fracture, meter; α, β is an empirical coefficient, taken α=1, β=2.3; $W_i^k$ is a width of the unit body i of the hydraulic fracture at the k-th fraction of time, meter; $C^{ui}$, $C^{li}$ are the shape coefficients of the upper and lower natural fracture entrance unit bodies with respect to the unit body i of the hydraulic fracture, respectively.

4. The method for acquiring an opening timing of natural fracture under an in-slit temporary plugging condition in claim 3, wherein the shape coefficients of the upper and lower natural fracture entrance unit bodies with respect to the unit body i of the hydraulic fracture are obtained by the following sub-steps:

sub-step S501: establishing a global coordinate system with a center point of the first hydraulic fracture unit body as an origin, a length direction of the hydraulic fracture as an X-axis, a direction passing through the origin and perpendicular to the wall surface of the hydraulic fracture as a Y-axis;

sub-step S502: expressing the coordinates of the midpoint of the upper and lower natural fracture entrance unit bodies in the global coordinate system as:

$$\begin{cases} x_u = x_r + \dfrac{L}{N}\square\cos\omega \\ y_u = \dfrac{L}{N}\square\sin\omega \\ x_l = x_r - \dfrac{L}{N}\square\cos\omega \\ y_l = -\dfrac{L}{N}\square\sin\omega \end{cases};$$

wherein $\overline{x}_u$, $\overline{y}^u$ is a coordinate of the midpoint of the upper natural fracture entrance unit bodies in the global coordinate system; $\overline{x}_l$, $\overline{y}_l$ is a coordinate of the midpoint of the lower natural fracture entrance unit bodies in the global coordinate system; $\overline{x}_r$ is an abscissa of the point where the hydraulic fracture intersects the natural fracture in the global coordinate system; L is a total length of hydraulic fracture, meter; N is the divided number of unit bodies of the hydraulic fracture; ω is an angle between the hydraulic fracture and the natural fracture, degree;

sub-step S503: expressing the coordinates of the midpoint of the upper and lower natural fracture entrance unit bodies in a local coordinate system based on the midpoint of the hydraulic fracture unit body i as:

$$\begin{cases} x_{ui} = \left(x_r + \dfrac{L}{N}\square\cos\omega - x_i\right)\cos\omega + \left(\dfrac{L}{N}\square\sin\omega - y_i\right)\sin\omega \\ y_{ui} = -\left(x_r + \dfrac{L}{N}\square\cos\omega - x_i\right)\sin\omega + \left(\dfrac{L}{N}\square\sin\omega - y_i\right)\cos\omega \\ x_{li} = \left(x_r - \dfrac{L}{N}\square\cos\omega - x_i\right)\cos\omega - \left(\dfrac{L}{N}\square\sin\omega + y_i\right)\sin\omega \\ y_{li} = -\left(x_r - \dfrac{L}{N}\square\cos\omega - x_i\right)\sin\omega - \left(\dfrac{L}{N}\square\sin\omega + y_i\right)\cos\omega \end{cases};$$

wherein $x_{ui}$, $y_{ui}$ is a coordinate of the midpoint of the upper natural fracture entrance unit bodies in the local coordinate system; $x_{li}$, $y_{li}$ is a coordinate of the midpoint of the lower natural fracture entrance unit bodies in the local coordinate system; $\overline{x}_i$, $\overline{y}_i$ is a coordinate of the unit body i of the hydraulic fracture in the global coordinate system; $\overline{x}_r$ an abscissa of the point where the hydraulic fracture intersects the natural fracture in the global coordinate system; L is a total length of hydraulic fracture, meter; N is the divided number of unit bodies of hydraulic fracture; ω is an angle between the hydraulic fracture and the natural fracture, degree; and sub-step S504: placing the formula in sub-step (S503) into the following formula for solution to obtain the shape coefficients of the upper and lower natural fracture entrance unit bodies with respect to the unit body i of the hydraulic fracture;

$$C^{ij}=2G[-f_1+y_{ij}(f_2 \sin 2\gamma^{ij}-f_3 \cos 2\gamma^{ij})];$$

$$\begin{cases} f_1 = \dfrac{1}{4\pi(1-\nu)}\left[\dfrac{x_{ij}-a}{(x_{ij}-a)^2+y_{ij}^2} - \dfrac{x_{ij}+a}{(x_{ij}+a)^2+y_{ij}^2}\right] \\ f_2 = \dfrac{1}{4\pi(1-\nu)}\left[\dfrac{(x_{ij}-a)^2-y_{ij}^2}{[(x_{ij}-a)^2+y_{ij}^2]^2} - \dfrac{(x_{ij}+a)^2-y_{ij}^2}{[(x_{ij}+a)^2+y_{ij}^2]^2}\right] \\ f_3 = \dfrac{2y_{ij}}{4\pi(1-\nu)}\left[\dfrac{x_{ij}-a}{[(x_{ij}-a)^2+y_{ij}^2]^2} - \dfrac{x_{ij}+a}{[(x_{ij}+a)^2+y_{ij}^2]^2}\right] \end{cases};$$

wherein $\delta_j^k$ is a normal stress of the fracture unit body j at the k-th fraction of time, MPa; G is a shear modulus of the stratum rock, MPa; $\upsilon$ is the Poisson's ratio of the stratum rock, no factor; $d_{ij}$ is the distance between the midpoints of the fracture unit i and the fracture unit j, meter; H is a height of the hydraulic fracture, meter; $\alpha$, $\beta$ are empirical coefficients, taken $\alpha=1$, $\beta=2.3$; i, j is the number of the unit body of hydraulic fracture; $W_i^0$ is a width of the i-th unit body of hydraulic fracture at the initial time, meter; $C^{ij}$ is a shape coefficient of the fracture unit j with respect to the unit body i of the hydraulic fracture; $\gamma^{ij}$ is a deflection angle of the fracture unit body i with respect to the fracture unit body j; a is a half-length of the fracture unit body, that is, L/2N, meter; $x_{ij}$, $y_{ij}$ is a coordinate value of the midpoint of the fracture unit body j in the local coordinate system based on the midpoint of the fracture unit body i.

* * * * *